US007335049B2

(12) United States Patent
Alarcon et al.

(10) Patent No.: US 7,335,049 B2
(45) **Date of Patent: *Feb. 26, 2008**

(54) CONNECTOR ASSEMBLY FOR HOUSING INSULATION DISPLACEMENT ELEMENTS

(75) Inventors: Sergio A. Alarcon, Austin, TX (US); Xavier Fasce, Verchaix (FR); Guy Metral, Cluses (FR); Jerome A. Pratt, Round Rock, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/296,968

(22) Filed: Dec. 8, 2005

(65) Prior Publication Data

US 2006/0160404 A1 Jul. 20, 2006

Related U.S. Application Data

(63) Continuation-in-part of application No. 10/941,441, filed on Sep. 15, 2004.

(51) Int. Cl.
*H01R 11/20* (2006.01)

(52) U.S. Cl. ..... 439/409; 439/404; 439/541.5

(58) Field of Classification Search ..... 439/403, 439/405, 409, 922
See application file for complete search history.

(56) References Cited

U.S. PATENT DOCUMENTS 3,596,232 A 7/1971 Medley
3,617,983 A 11/1971 Patton
3,621,117 A 11/1971 Antas et al.
3,634,604 A 1/1972 Dola
3,702,456 A 11/1972 Patton
3,708,779 A * 1/1973 Enright et al. ..... 439/392
3,845,455 A 10/1974 Shoemaker
3,854,114 A 12/1974 Kloth et al.
3,937,545 A 2/1976 Cairns et al.

(Continued)

FOREIGN PATENT DOCUMENTS

DE 33 13 654 A1 10/1984

(Continued)

OTHER PUBLICATIONS 3M 4500 Modular Terminating System, Technical Report, Oct. 1993, 20 pages, 3M Telecom and Visual Systems Group, Austin, Texas 78726.

(Continued)

*Primary Examiner*—Briggitte R. Hammond
*Assistant Examiner*—Larisa Tsukerman
(74) *Attorney, Agent, or Firm*—Janet A. Kling; John A. Burtis

(57) ABSTRACT

An electrical connector for terminating at least one electrical conductor comprises a first side and a second side each comprising a housing including a cavity for receiving at least a first IDC element, a cap including a pivot portion and a cover portion, where the pivot portion is pivotally mounted to the housing to allow the cap to be pivoted between an open position and a closed position, at least one recess in the pivot portion of the cap, and a cutting edge within the cavity of the housing adjacent to the recess in the pivot portion of the cap.

20 Claims, 11 Drawing Sheets

U.S. PATENT DOCUMENTS 4,017,140 A 4/1977 Reavis, Jr. et al.
4,046,446 A 9/1977 Reavis, Jr.
4,127,312 A * 11/1978 Fleischhacker et al. ..... 439/403
4,192,570 A 3/1980 Van Horn
4,214,805 A * 7/1980 Faulconer ..... 439/417
4,326,767 A 4/1982 Silbernagel et al.
4,349,239 A * 9/1982 Roberts et al. ..... 439/287
4,444,447 A * 4/1984 Markwardt ..... 439/392
4,508,411 A 4/1985 Hughes et al.
4,522,459 A 6/1985 Hardesty et al.
4,533,196 A 8/1985 Forberg et al.
4,541,679 A 9/1985 Fiedler et al.
4,552,429 A * 11/1985 van Alst ..... 439/404
4,679,881 A 7/1987 Galvin et al.
4,795,363 A 1/1989 Scherer et al.
4,815,988 A 3/1989 Scherer
4,846,735 A * 7/1989 Teichler et al. ..... 439/709
4,875,875 A 10/1989 Archer et al.
4,932,894 A 6/1990 Scherer
4,954,798 A * 9/1990 Kasahara et al. ..... 335/161
4,988,311 A 1/1991 Tanzola
4,995,829 A 2/1991 Geib et al.
5,000,703 A * 3/1991 Biederstedt et al. ..... 439/709
5,092,792 A * 3/1992 Nilsson ..... 439/403
5,127,845 A 7/1992 Ayer et al.
5,139,440 A 8/1992 Volk et al.
5,178,558 A 1/1993 Knox et al.
5,195,907 A 3/1993 Urban
5,199,899 A 4/1993 Ittah
5,281,163 A 1/1994 Knox et al.
5,281,164 A * 1/1994 Gan ..... 439/409
5,295,857 A 3/1994 Toly
5,314,350 A * 5/1994 Matthews et al. ..... 439/404
5,338,220 A * 8/1994 Soes et al. ..... 439/403
5,360,352 A * 11/1994 Rudy et al. ..... 439/469
5,435,747 A * 7/1995 Franckx et al. ..... 439/409
5,449,299 A 9/1995 Shimirak et al.
5,451,170 A * 9/1995 Suffi ..... 439/404
5,453,024 A 9/1995 Patinier
5,498,174 A * 3/1996 Speer et al. ..... 439/567
5,504,654 A 4/1996 Knox et al.
5,531,612 A * 7/1996 Goodall et al. ..... 439/541.5
5,549,489 A 8/1996 Baggett et al.
RE35,325 E 9/1996 Wass et al.
5,551,889 A 9/1996 Kozel et al.
5,556,296 A 9/1996 Dussausse et al.
5,575,689 A * 11/1996 Baggett et al. ..... 439/709
5,664,963 A 9/1997 Yamamoto et al.
5,667,402 A 9/1997 Denovich et al.
5,683,268 A * 11/1997 Drach et al. ..... 439/404
5,762,518 A 6/1998 Tanigaawa et al.
5,779,504 A * 7/1998 Dominiak et al. ..... 439/709
5,785,548 A 7/1998 Capper et al.
5,797,759 A 8/1998 Mattis et al.
5,836,791 A * 11/1998 Waas et al. ..... 439/709
5,939,672 A * 8/1999 Tang ..... 174/50.5
5,944,559 A 8/1999 Wu
5,947,761 A * 9/1999 Pepe ..... 439/409
5,961,341 A * 10/1999 Knowles et al. ..... 439/403
5,967,826 A 10/1999 Letailleur
6,015,312 A * 1/2000 Escane ..... 439/417
6,027,370 A * 2/2000 Hsu et al. ..... 439/541.5
6,056,584 A 5/2000 Daoud
6,089,902 A 7/2000 Daoud
6,099,343 A 8/2000 Bonvallat et al.
6,139,352 A * 10/2000 Daoud ..... 439/404
6,152,760 A 11/2000 Reeser
6,159,036 A 12/2000 Daoud
6,188,560 B1 2/2001 Waas
6,193,556 B1 2/2001 Escane
6,222,717 B1 * 4/2001 Waas et al. ..... 361/119
6,254,420 B1 * 7/2001 Letailleur et al. ..... 439/392
6,254,421 B1 7/2001 Denovich et al.
6,406,324 B1 6/2002 Duesterhoeft et al.
6,413,120 B1 * 7/2002 Winings et al. ..... 439/676
6,582,247 B2 6/2003 Siemon
6,604,956 B2 8/2003 Ruiz et al.
6,655,981 B2 * 12/2003 Seki ..... 439/403
6,676,430 B1 1/2004 Conorich
6,811,430 B1 11/2004 Carrico et al.
6,893,280 B2 5/2005 Thompson et al.
7,101,216 B2 9/2006 Fasce et al.
7,223,117 B2 5/2007 Pratt
2002/0094715 A1 7/2002 Pepe et al.
2003/0049961 A1 3/2003 Tricaud et al.
2003/0156389 A1 8/2003 Busse et al.
2003/0184204 A1 10/2003 McCoy et al.
2003/0224628 A1 * 12/2003 Korsunsky et al. ..... 439/65
2004/0002258 A1 * 1/2004 Zheng et al. ..... 439/541.5
2006/0063417 A1 3/2006 Liu et al.
2006/0264090 A1 11/2006 Dower et al.
2006/0264117 A1 11/2006 Hills et al.
2007/0004272 A1 1/2007 Pratt
2007/0020988 A1 1/2007 Frenken

FOREIGN PATENT DOCUMENTS

DE 43 19 565 C1 7/1994
EP 0 073 740 B1 6/1985
EP 0 220 884 A2 5/1987
EP 0 310 339 4/1989
EP 0 271 413 B1 5/1992
EP 0 718 915 B1 7/1997
EP 0 878 866 11/1998
FR 2 730 096 A1 8/1996
GB 2 129 628 A 5/1984
GB 2 149 231 A 6/1985
GB 2 293 696 A 4/1996
WO WO 99/04454 1/1999
WO WO 99/04455 1/1999
WO WO 01/57957 A1 8/2001

OTHER PUBLICATIONS

U.S. Appl. No. 29/213,197, filed Sep. 15, 2004, entitled "Cap for Electrical Connector".

* cited by examiner

CONNECTOR ASSEMBLY FOR HOUSING INSULATION DISPLACEMENT ELEMENTS

CROSS-REFERENCE TO RELATED APPLICATIONS

The present application is a continuation-in-part of U.S. patent application Ser. No. 10/941,441, entitled "CONNECTOR ASSEMBLY FOR HOUSING INSULATION DISPLACEMENT ELEMENTS," and filed on Sep. 15, 2004 by Jerome Pratt, Xavier Fasce, and Guy Metral.

FIELD

The present invention relates to insulation displacement connectors. In one particular aspect, the present invention relates to a dual-sided insulation displacement connector block configured to house at least one pair of electrically connected insulation displacement elements for use in making an electrical connection between at least one pair of electrical conductors.

BACKGROUND

In a telecommunications context, connector blocks are connected to cables (i.e., electrical conductors) that feed subscribers while other connector blocks are connected to cables to the central office. To make the electrical connection between the subscriber block and the central office block, jumper wires are inserted to complete the electrical circuit. Typically jumper wires can be connected, disconnected, and reconnected several times as the consumer's needs change.

An insulation displacement connector (IDC) element is used to make the electrical connection to a wire or electrical conductor. The IDC element displaces the insulation from a portion of the electrical conductor when the electrical conductor is inserted into a slot within the IDC element so the IDC element makes electrical connection to the electrical conductor. Once the electrical conductor is inserted within the slot with the insulation displaced, electrical contact is made between the conductive surface of the IDC element and the conductive core of the electrical conductor.

Typically the IDC element is housed in an insulated housing. Often, the housing has a cap or other moveable member that is movable to press the electrical conductor into contact with the IDC element. Typically, when inserting the electrical conductor in the housing, the cap closes and the user is then unable to visually verify that the electrical conductor made a proper connection with the IDC element. The user then may not be sure whether an effective connection has been made between the electrical conductor and the IDC element.

Another problem associated with connection devices is that inserting the electrical conductor into the IDC element slot often requires a significant force, which may require the use of special tools or devices. Often the cap is adapted to be used as the insertion device for inserting the electrical conductors into the IDC element slots. However, closing the cap to insert the electrical conductor into the IDC element slot may require a significant force and may strain the user's finger or hand.

BRIEF SUMMARY

In a first aspect, the present invention provides an electrical connector for terminating at least one electrical conductor. The connector comprises a first side and a second side opposite the first side. The first and second sides each comprise a housing including a cavity for receiving an IDC element, a cap pivotable between an open position and a closed position, and including a pivot portion and a cover portion, where the pivot portion is pivotally mounted to the housing. The first and second sides each further comprise a recess in the pivot portion of the cap, and a cutting edge within the cavity of the housing adjacent to the recess in the pivot portion.

In a second aspect, the present invention provides an electrical connector assembly comprising a base unit having a first side including a first set of insulation displacement connector (IDC) elements, and a second side on an opposite side of the base unit from the first side, the second side including a second set of IDC elements. The connector assembly further comprises a first connector unit configured to attach to the first side of the base unit and including a first set of housings, a first set of caps configured to pivotally mount to at least one housing of the first set of housings, a second connector unit configured to attach to the second side of the base unit and including a second set of housings, and a second set of caps configured to pivotally mount to at least one housing of the second set of housings. Each cap of the first and second sets of caps includes a recess configured to receive an electrical conductor. Each housing of the first and second sets of housings includes a cutting edge positioned to align with the recess in at least one of the caps.

In a third aspect, the present invention provides a method of electrically connecting first and second electrical conductors. The method comprises providing an insulation displacement connector (IDC) block that includes a first side and a second side opposite the first side. The first side of the IDC block comprises a first housing including a first cavity, a first IDC element disposed within the first cavity of the first housing, and a first cap pivotally mounted to the first housing. The first cap includes a first pivot portion and a first cover portion, the first pivot portion including a first recess. The second side of the IDC block comprises a second housing including a second cavity, a second IDC element disposed within the second cavity of the second housing, and a second cap pivotally mounted to the second housing and including a second pivot portion and a second cover portion. The second pivot portion includes a second recess. The second IDC element is electrically connected to the first IDC element. The method further comprises pivoting the first cap to a first open position relative to the first cavity of the first housing, introducing the first electrical conductor into the first cavity, introducing the first electrical conductor into the first recess in the first pivot portion, and pivoting the first cap to a first closed position relative to the first cavity of the first housing, whereby the first electrical conductor is urged into a first slot within the first IDC element. The method further comprises pivoting the second cap to a second open position relative to the second cavity of the second housing, introducing the second electrical conductor into the second cavity, introducing the second electrical conductor into the second recess in the second pivot portion, and pivoting the second cap to a second closed position relative to the second cavity of the second housing, whereby the second electrical conductor is urged into a second slot within the second IDC element.

In a fourth aspect, the present invention provides a method of electrically connecting first and second electrical conductors. The method comprises providing an insulation displacement connector (IDC) block comprising a first side and a second side opposite the first side. The first and second sides each comprise a housing including a cavity, an IDC element disposed within the housing, a cap pivotally mounted to the housing and including a cover portion and a pivot portion including a recess, and a cutting edge disposed within the cavity of the housing adjacent the recess in the pivot portion of the cap. The IDC element of the first side is electrically connected to the IDC element of the second side. The method comprises, for each one of the first and second sides, pivoting the cap to an open position relative to the cavity of the housing, introducing an electrical conductor into the cavity and into the recess in the pivot portion, and pivoting the cap to a closed position relative to the cavity of the housing. The cutting edge severs the electrical conductor passing in the recess, and the cap urges the electrical conductor into a slot within the IDC element.

The above summary is not intended to describe each disclosed embodiment or every implementation of the present invention. The figures and the detailed description presented below more particularly exemplify illustrative embodiments of the invention.

While the above-identified figures set forth several embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the spirit and scope of the principals of this invention. The figures may not be drawn to scale. Like reference numbers have been used throughout the figures to denote like parts.

DETAILED DESCRIPTION

The present invention is an insulation displacement connector (IDC) block (or simply "connector block") that houses insulation displacement elements (i.e., IDC elements). The connector block is used to form an electrical connection between at least two electrical conductors. In a first exemplary embodiment, the connector block generally includes a plurality of housings, a cap connected to each housing, and at least one IDC element disposed within each housing. Each IDC element is electrically connected to at least one other IDC element. For example, a first IDC element may be electrically connected to a second IDC element. If a first electrical conductor is in electrical contact with the first IDC element and a second electrical conductor is in electrical contact with the second IDC element, the first and second electrical conductors are electrically connected. In this way, the connector block electrically connects at least two electrical connectors. The first exemplary embodiment is described in reference to FIGS. 1-12.

In a second exemplary embodiment, the connector block includes a first side and a second side each including a plurality of housings, a cap connected to each housing, and at least one IDC element disposed within each housing. An IDC element on the first side of the connector block is electrically connected to at least one IDC element on the second side of the connector block. The second exemplary embodiment is described in reference to FIGS. 13-15.

Figure 1:
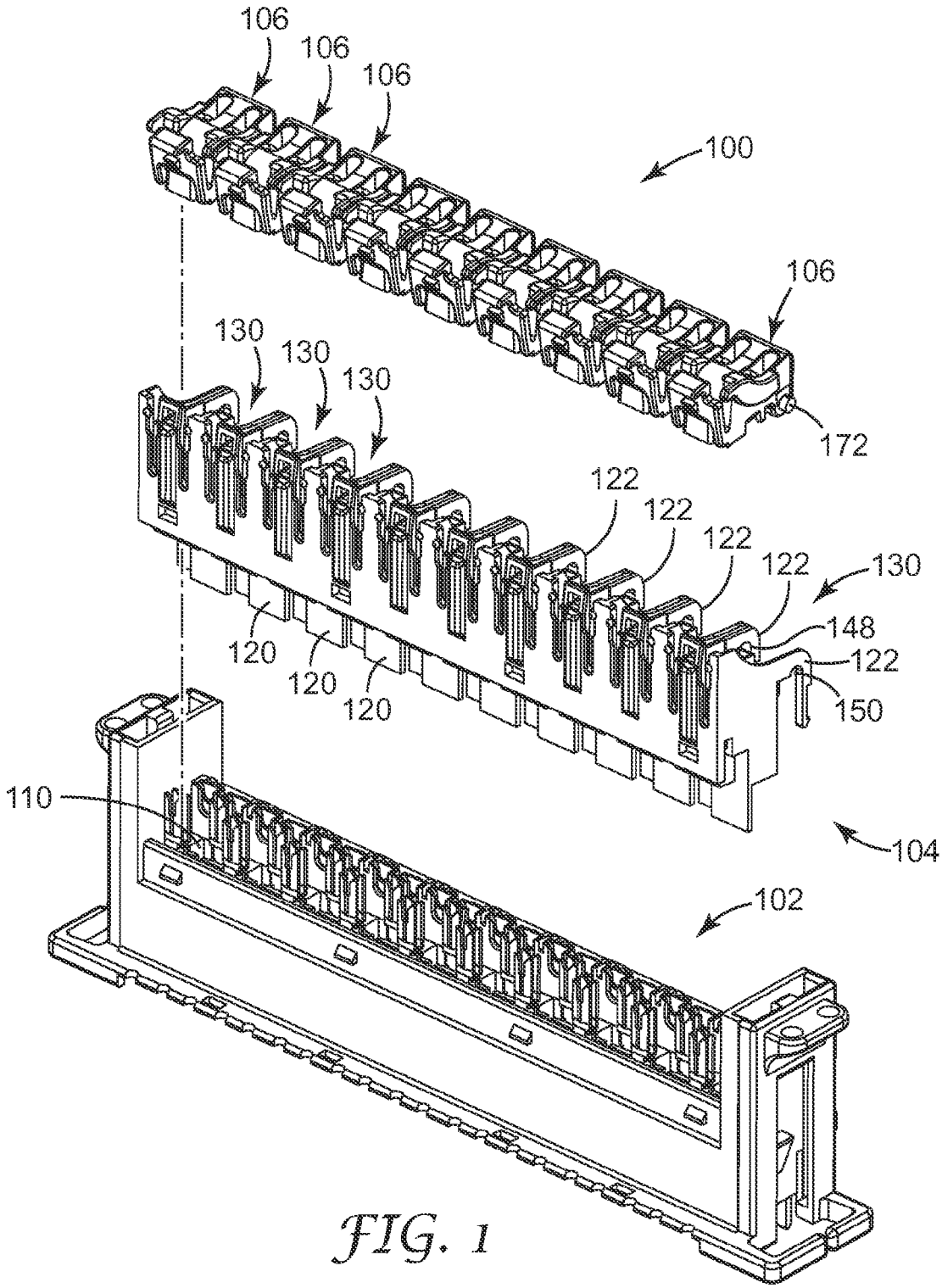
FIG. 1 is an exploded perspective view of a first exemplary embodiment of an connector assembly of the present invention.

FIG. 1 is an exploded perspective view of a first embodiment of an insulation displacement connector assembly 100 of the present invention. The connector assembly 100 comprises a base unit 102, a connector unit 104, and a plurality of caps 106. In FIG. 1, the connector assembly 100 is shown disassembled. To assemble the connector assembly 100, the caps 106 are inserted in between lock projections 122 projecting from a rear side of the connector unit 104 and then the connector unit 104 is placed over and slid into the base unit 102.

The base unit 102 comprises an insulated housing with a series of receiving slots 110 for connection with the connector unit 104. Lock slots on a rear side of the base unit 102 receive lock projections 122 of the connector unit 104 to lock the connector unit 104 to the base unit 102.

Figure 11:
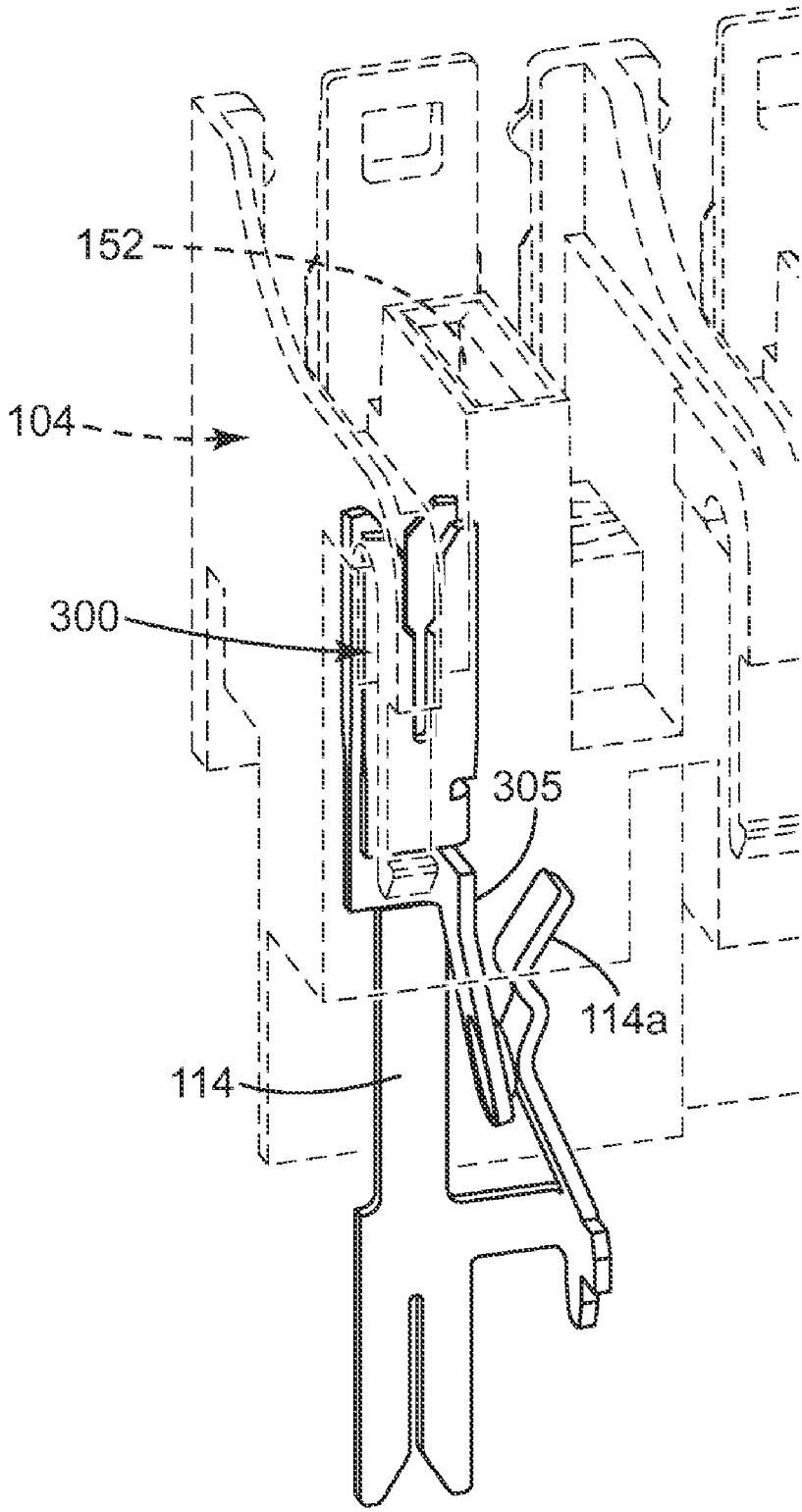
FIG. 11 is a perspective view through the connector unit (shown in phantom) in accordance with a first exemplary embodiment of the present invention, illustrating the connection between the insulation displacement element and an electrical element.
Figure 12:
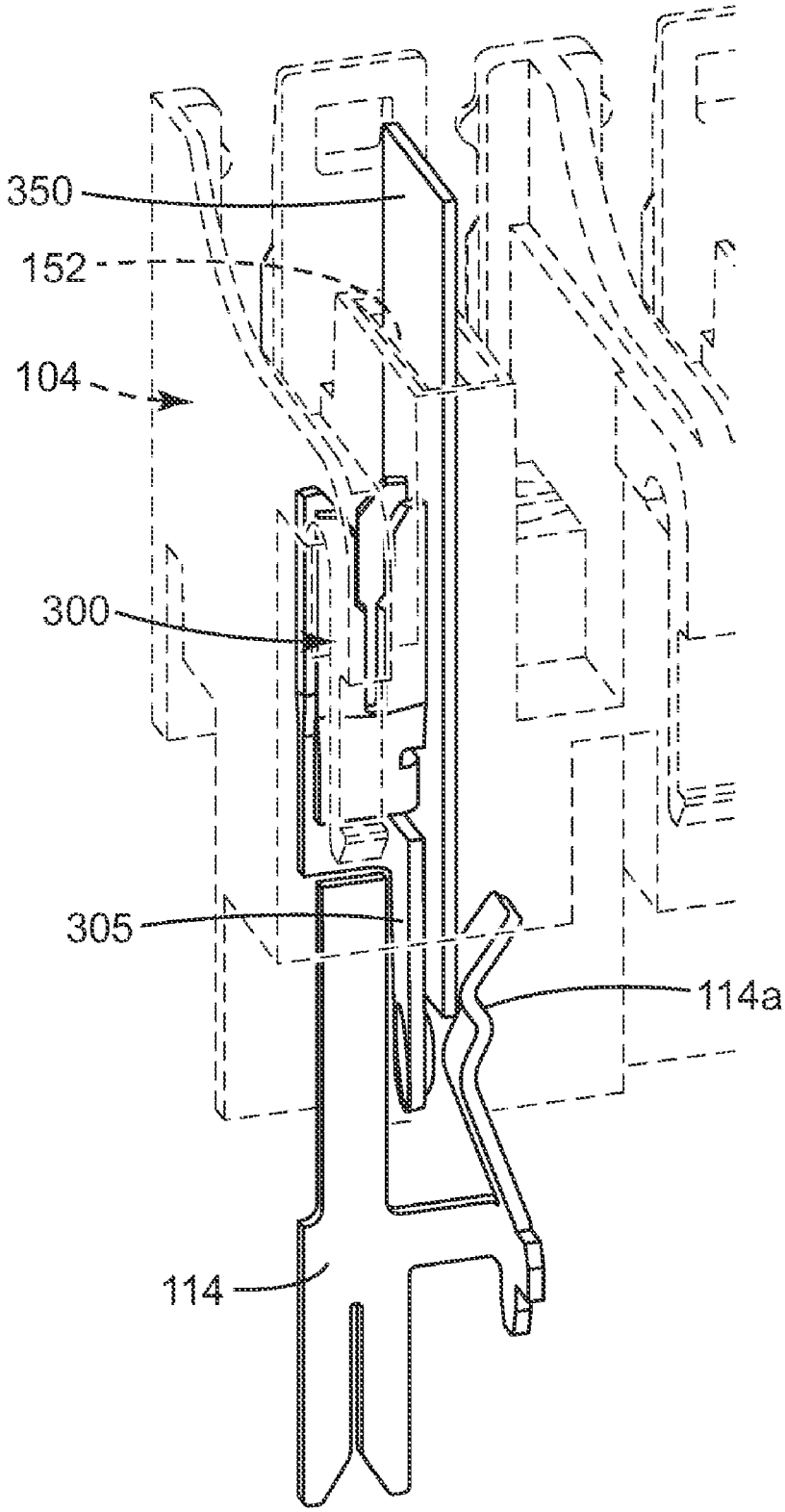
FIG. 12 is a perspective view through the connector unit (shown in phantom) in accordance with the first exemplary embodiment of the present invention, illustrating a test probe inserted between the connection of the insulation displacement element and an electrical element.

Located within the base unit 102 are a plurality of electrical elements 114 (see FIGS. 11 and 12). Each electrical element 114 is in the form of an IDC element (also known as an "insulation displacement element"), and is adapted to make electrical contact with a corresponding IDC element in the connector assembly 100, as explained below.

The connector unit 104 comprises an insulated housing with a series of alignment projections 120 for connection into the receiving slots 110 of the base unit 102. The lock projections 122 project outwardly and downwardly from the rear side of the connector unit 104 and lock within the lock slots on the rear side of the base unit 102 to lock the connector unit 104 to the base unit 102.

Each cap 106 is independently pivotally mounted onto the connector unit 104, relative to a respective housing 130. Each cap 106 comprises a first pivot projection 170 and a second coaxial pivot projection 172 (see FIG. 3) opposite the first pivot projection 170, which enter and engage with the connector unit 104 at a gap 124 created between adjacent lock projections 122, as they project outwardly and downwardly from the rear side of the connector unit 104. For assembly, the pivot projections 170, 172 of the cap 106 are first inserted within the gap 124 and connected to the connector unit 104 prior to the connector unit 104 being attached to the base unit 102. Once the connector unit 104 is attached and locked within the base unit 102, the first and second pivot projections 170, 172 of the cap 106 are secured within hinge slots 148, 150, respectively, on adjacent lock projections 122, and within the gap 124 to prevent the cap 106 from being removed. However, the pivot projections 170, 172 allow for pivoting movement of the cap 106 relative to the connector unit 104, within the hinge slots 148, 150. In some embodiments, each one of the caps 106 is connected to the connector unit 106, as described in U.S. patent application Ser. No. 11/296945, entitled "CAP CONFIGURED TO ATTACH TO AN INSULATION DISPLACEMENT CONNECTOR BLOCK" and filed on even date herewith.

The connector unit 104 shown in FIG. 1 comprises a plurality of housings 130 and associated caps 106. A separate cap 106 is provided to cover each housing 130. Each connector assembly 100 is a self-contained unit, insulated from the next adjacent assembly 100. However, the connector assembly 100 may comprise any number of housings 130, base units 102, and caps 106. Each housing 130, base unit 102 and cap 106 form an assembly that is adapted to receive at least one pair of electrical conductors, as explained below. Because the connector assembly 100 may comprise any number of housings 130, base units 102, and caps 106 there can be any number of a pair of electrical conductors, such as but not limited to one, 5, 10, or 50 pairs.

The connector assembly 100 may be constructed, for example, of an engineering plastic such as, but not limited to: Valox® 325 a polybutylene terephthalate (PBT) polymer, available from GE Plastics of Pittsfield, Mass.; Lexan® 500R a polycarbonate resin, flame retardant, 10% glass fiber reinforced grade available from GE Plastics of Pittsfield, Mass.; Mackrolon® 9415 a polycarbonate resin, flame retardant, 10% glass fiber reinforced grade available from Bayer Plastics Division of Pittsburgh, Pa.; or Mackrolon® 9425 a polycarbonate resin, flame retardant, 20% glass fiber reinforced grade available from Bayer Plastics Division of Pittsburgh, Pa.

The caps 106 may be constructed, for example, of an engineering plastic such as, but not limited to: Ultem® 1100 a polyether imide resin available from GE Plastics of Pittsfield, Mass.; Valox® 420 SEO a polybutylene terephthalate (PBT) resin flame retardant, 30% glass fiber reinforced available from GE Plastics of Pittsfield, Mass.; IXEF® 1501 a polyarylamide resin, flame retardant, 30% glass fiber reinforced grade available from Solvay Advanced Polymers, LLC of Alpharetta, Ga.; or IXEF® 1521 a polyarylamide resin, flame retardant, 50% glass fiber reinforced grade available from Solvay Advanced Polymers, LLC of Alpharetta, Ga.

Figure 2:
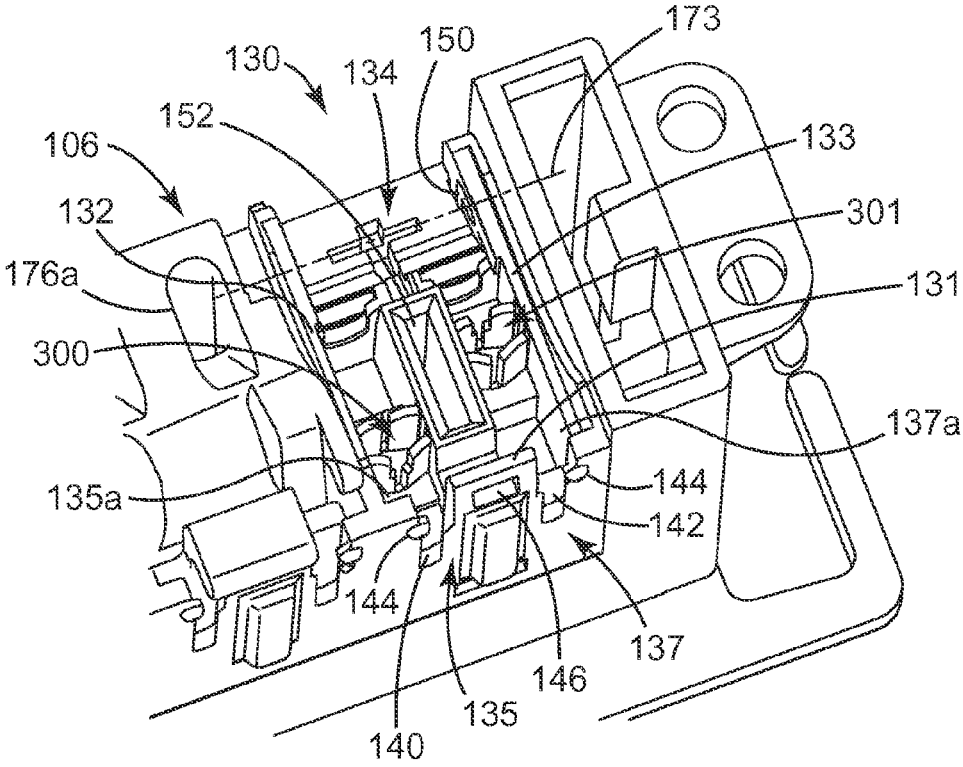
FIG. 2 is an assembled perspective view of a portion of the connector assembly of the present invention, with one of a plurality of pivoting caps removed for clarity of illustration.

FIG. 2 is an assembled perspective view of a portion of the connector assembly 100 of the present invention, with one of the pivoting caps 106 omitted to show the internal configuration and components of one of the housings 130. Also, electrical conductors (i.e., wires), which would otherwise be in the housing 130 when fully assembled for operation, have been omitted to show the internal configuration and components of the housing 130.

Each housing 130 comprises a front wall 131, a first side wall 132, a second side wall 133, and a base 134. The housing 130 is formed to have a first section 135 and a second section 137. The first section 135 of the housing 130 forms a first cavity 135*a* and the second section 137 of the housing 130 forms a second cavity 137*a*. Separating the first section 135 from the second section 137 is a test probe slot 152.

Figure 3:
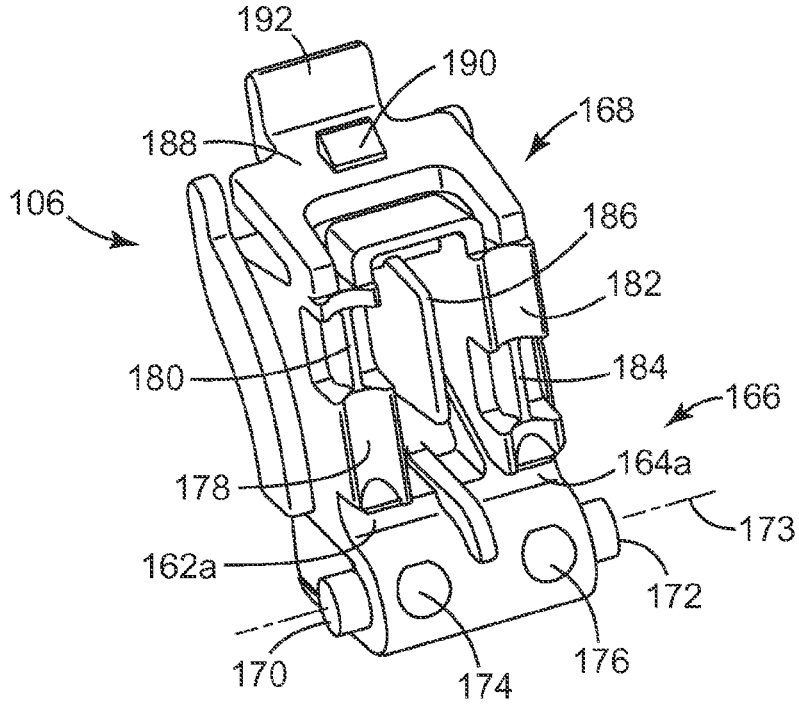
FIG. 3 is a perspective view of the underside of one of the caps.
Figure 4:
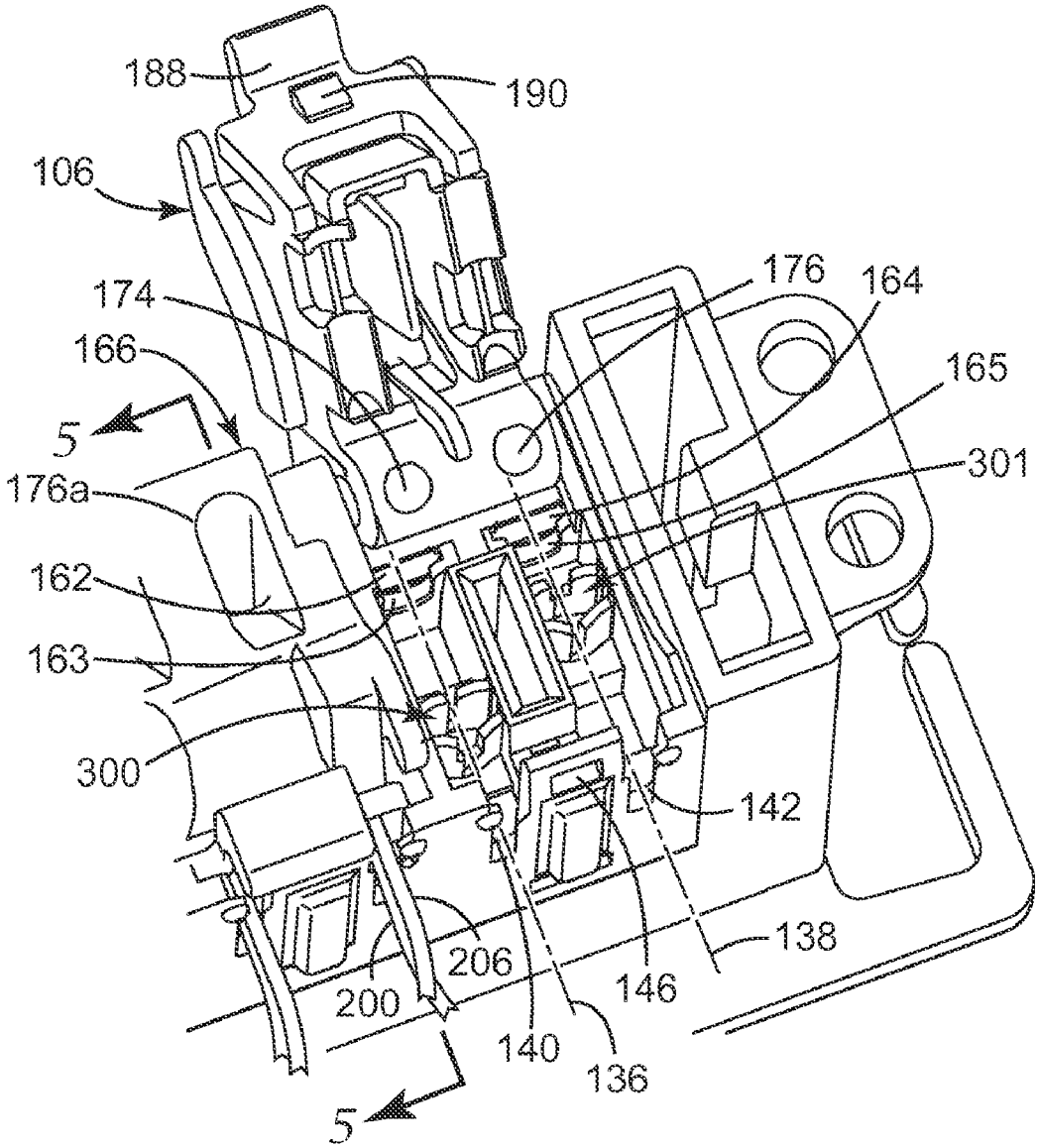
FIG. 4 is a perspective view of a portion of the assembled connector unit, showing one of the caps in a pivoted open position relative to a housing.

Along the front wall 131 is a first wire groove 140 and a second wire groove 142, which allow entry of the electrical conductors into the housing 130 (see FIG. 4). Wire retainer projections 144 extend laterally into the grooves 140 and 142 to resiliently hold the electrical conductors within the first wire groove 140 and second wire groove 142, and prevent the electrical conductors from moving out of the open ends of the grooves 140, 142. A latch opening 146 is also disposed on the front wall 131, which is capable of receiving a latch projection 190 (see FIG. 3) on the cap 106 to lock the cap 106 to the front wall 131 of the housing 130 and prevent the cap 106 from accidentally opening (see FIG. 4).

Along the first side wall 132 is a first hinge slot 148, and along the second side wall 133 is a second hinge slot 150 (see FIGS. 1 and 2). Each hinge slot 148, 150 is created by a portion of the gap 124 of the lock projections 122 extending out and down from the housing 130. The hinge slots 148, 150 pivotally receive the pivot projections 170, 172 extending laterally from the cap 106, to allow the cap 106 to pivot along a pivot axis 173 (see FIGS. 2 and 3).

The base 134 of the housing 130 includes the test probe slot 152, which essentially separates the first section 135 of the housing 130 from the second section 137 of the housing 130. The test probe slot 152 may be divided into two portions with the first allowing for testing of the electrical connections on the first section 135 of the housing 130 and the second allowing for testing of the electrical connections on the second section 137 of the housing 130. Test probes as are known in the art are inserted into the test probe slot 152 (see, e.g., FIG. 12).

As seen in FIG. 2, extending from the base 134 of the first section 135 of the housing 130 is a first IDC element 300, and extending from the base 134 of the second section 137 of the housing 130 is a second IDC element 301. Each IDC element 300, 301 is conductive and capable of displacing the insulation from electrical conductors to electrically couple the conductive cores of the electrical conductors to the IDC elements. For example, the IDC elements 300, 301 may be constructed of phosphor bronze alloy C51000 per ASTM B103/103M-98e2 with reflowed matte tin plating of 0.000150-0.000300 inches thick, per ASTM B545-97(2004) e2 and electrodeposited nickel underplating, 0.000050 inches thick minimum, per SAE-AMS-QQ-N-290 (July 2000).

FIG. 3 is a perspective view of the underside of the cap 106. The cap 106 includes a pivot portion 166 and a cover portion 168. Extending laterally from the pivot portion 166 are the first pivot projection 170 and second pivot projection 172. The pivot projections 170, 172 engage with the hinge slots 148, 150 of the side walls 132, 133 of the housing 130 to secure the cap 106 to the housing 130 while allowing for pivoting movement of the cap 106 along the pivot axis 173.

Extending into the pivot portion 166 is a first recess 174 and second recess 176. The recesses 174, 176 may be a through hole extending through the entire pivot portion 166 of the cap 106, or may extend through only a portion of the pivot portion 166 of the cap 106. The first recess 174 is aligned with the first section 135 of the housing 130, and the second recess 176 is aligned with the second section 137 of the housing 130. Each recess 174, 176 receives electrical conductors passing through the housing 130. Although the first recess 174 and second recess 176 are shown as parallel recesses through the pivot portion 166, it is within the scope of the present invention that the first recess 174 and second recess 176 may not be parallel to one another.

Figure 6:
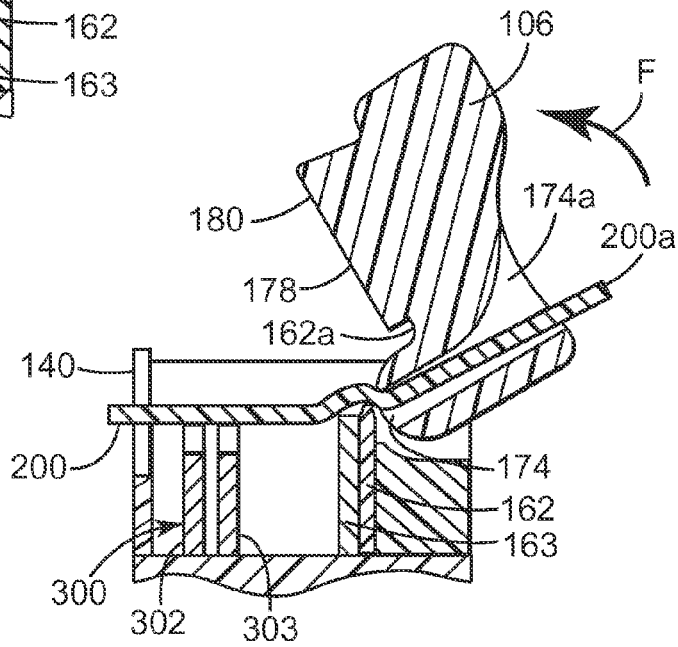
FIG. 6 is a schematic sectional view through the connector unit of FIG. 4, with the electrical conductor inserted through the recess in the cap and the cap in a partially closed position relative to the housing.

The cover portion 168 of the cap 106 is moveable from an open position (FIG. 4) to a closed position (e.g., FIG. 7) to cover the open top of the housing 130. Adjacent the pivot portion 166 of the cap is a first indent 162*a* and a second indent 164*a*. A first wire hugger 178 and a first wire stuffer 180 are located on the cover portion 168, adjacent the first section 135 of the housing 130. A second wire stuffer 184 and a second wire hugger 182 are located on the cover portion 168 adjacent the second section 137 of the housing 130. When the cap 106 is closed, the underside of the cover portion 168 of the cap 106 engages the electrical conductor. The first wire hugger 178 and first wire stuffer 180 engage an upper exposed surface of the electrical conductor. Upon complete closure of the cap 106, the first wire stuffer 180 (being aligned with a first IDC element 300) follows and pushes the electrical conductor into the first IDC element 300. (FIG. 6). A similar closing occurs at the second IDC element 301. However, because the second IDC element 301 is closer to the pivot axis 173 of the pivot portion 166 of the cap 106, the second wire stuffer 184 is arranged on the cap 106 accordingly (i.e., the positions of the wire stuffers 180 and 184 are staggered radially relative to the pivot axis 173). The overall length of the wire stuffers 180,184 may be uniform or may be different from one another depending on the sequencing desired for pushing the electrical conductors into the IDC elements 300, 301. Extending through the center of the cover portion 168 is a test probe slot cap 186, which partially enters the test probe slot 152 when the cap 106 is closed.

A resilient latch 188, which is capable of flexing relative to the cover portion 168 of the cap 106, is located on the cover portion 168 of the cap 106. When the cap 106 is closed, the resilient latch 188 flexes so that the latch projection 190 on the resilient latch 188 can enter the latch opening 146 on the front wall 131 of the housing 130. When the latch projection 190 is engaged with the latch opening 146, the cap 106 is secured to the housing 130 and will not open. To open the cap 106, a release lever 192 on the resilient latch 188 is pressed rearwardly to disengage the latch projection 190 from the latch opening 146. Then, the cap 106 can be pivoted open, as shown in FIG. 4, for access to the cavity within the housing 130 and electrical conductors and IDC elements therein.

In some embodiments, the cap 106 includes an opening in the cover portion 168 configured to receive a testing device, as described in U.S. patent application Ser. No. 11/297281, entitled "ACCESS COVER CONFIGURED TO RECEIVE A TESTING DEVICE" and filed on even date herewith.

FIG. 4 is a perspective view of the connector unit 104 showing a housing 130 with the cap 106 attached in an open position. Again, the electrical conductors have been omitted in FIG. 4 to show the internal configuration and components of the housing 130. However, first electrical conductor 200 and second electrical conductor 206 can be seen extending from the adjacent housing.

The first IDC element 300 and a first blade 162 are located at the base 134 of the first section 135 of the housing 130. The first blade 162 is located adjacent the pivot portion 166 of the cap 106. A first support 163 with a generally U-shape to support and cradle an electrical conductor when inserted into the housing 130 is positioned in front of the first blade 162. When the cap 106 is closed and pressing down on the electrical conductor, the first support 163 supports the electrical conductor so that the first blade 162 can properly and effectively cut the electrical conductor. Then, the first blade 162 enters the first indent 162*a* on the cap 106.

The second IDC element 301 and a second blade 164 are located at the base 134 of the second section 137 of the housing 130. The second blade 164 is located adjacent the pivot portion 166 of the cap 106. A second support 165 with a generally U-shape to support and cradle an electrical conductor when inserted into the housing 130 is positioned in front of the second blade 164. When the cap 106 is closed and pressing down on the electrical conductor, the second support 165 supports the electrical conductor so that the second blade 164 can properly and effectively cut the electrical conductor. Then, the second blade 164 enters the second indent 164*a* on the cap 106.

Figure 5:
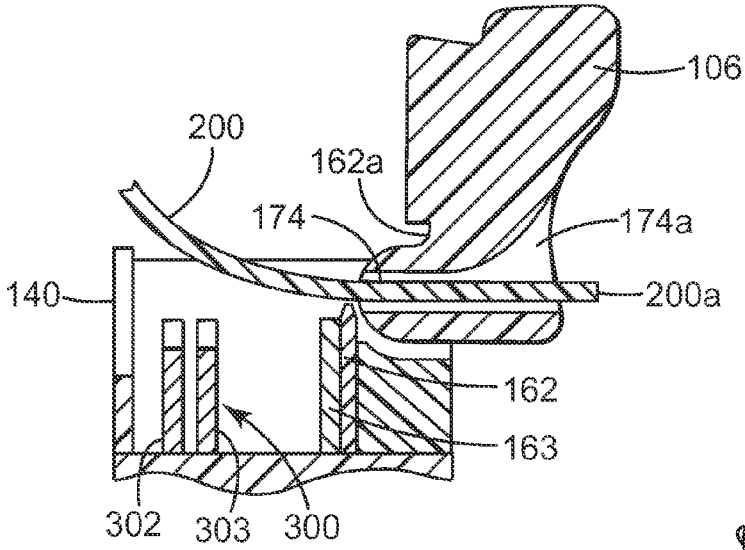
FIG. 5 is a schematic sectional view through the connector unit of FIG. 4, with an electrical conductor inserted through a recess in the cap and the cap in a fully opened position relative to the housing.
Figure 7:
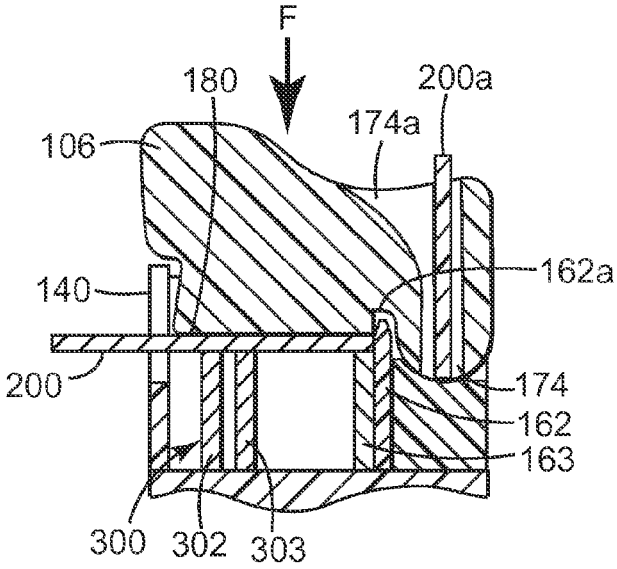
FIG. 7 is a schematic sectional view through the connector unit of FIG. 4, with the electrical conductor inserted through the recess being cut and the cap in a fully closed position relative to the housing.

The first blade 162 and second blade 164 may be constructed of a metallic material and have a slightly sharpened edged, as is more clearly shown in FIGS. 5-7. For example, the blades may be constructed of stainless steel alloy S30100, full hard temper, per ASTM A666-03. In addition, the blades 162, 164 may be constructed of a component extending from the base 134 of the housing 130, and therefore be non-metallic. In such a case, the blades 162,164 may also have a slightly sharpened edge, which creates a pinch point to cut the electrical conductors when the cap 106 is moved to a closed position.

It is preferable to insert a single electrical conductor into each section 135, 137 of the housing 130 and into the recesses 174, 176, respectively, to be cut by the blades 162, 164, respectively. However, in some instances two electrical conductors may be inserted into each section 135, 137 of the housing 130 and into the recesses 174, 176, respectively, to be cut by the blades 162, 164, respectively. Further, the first blade 162 and second blade 164 shown in FIG. 4 are symmetrically arranged within the housing 130. However, the first and second blades 162, 164 may be staggered (radially displaced relative to the pivot axis 173) or may have different heights relative to the base 134 of the housing 130. By either staggering the blades 162, 164 or varying the heights of the blades 162, 164, it is possible to vary the sequencing of cutting the electrical conductors, thereby minimizing the force needed to close the cap 106 and cut the electrical conductors.

FIG. 4 shows the linear arrangement of the first IDC element 300 on the first section 135 of the housing 130 and the second IDC element 301 on the second section 137 of the housing 130. As can be seen, the first wire groove 140, first IDC element 300, first support 163, first blade 162, and first recess 174 in the cap 106 are generally linearly arranged along a first plane 136 within the first section 135 of the housing 130. Within the second section 137 of the housing 130, the second wire groove 142, second IDC element 301, second support 165, second blade 164, and second recess 176 in the cap 106 are generally linearly arranged along a second plane 138. Relative to the pivot axis 173 of the cap 106, the first IDC element 300 and the second IDC element 301 are off-set (i.e., radially staggered) from one another along their respective planes, 136, 138. As shown, the second IDC element 301 is closer to the pivot portion 166 of the cap 106 than the first IDC element 300. This staggering of the first IDC element 300 and second IDC element 301 minimizes the force needed to be applied to the cap 106 to properly close the cap 106 and engage all electrical conductors in each IDC element, because the electrical conductors are not being forced into their respective IDC elements at the same time during closure. Instead, the electrical conductor for the IDC element closest to the pivot portion 166 of the cap 106 (second IDC element 301) is pressed into engagement first, and the electrical conductor at the IDC element farthest from the pivot portion 166 of the cap 106 (first IDC element 300) is pressed into engagement last. Further, the cutting of the electrical conductors during cap 106 closure (at each blade 162, 164) can occur during insertion but prior to final insertion is reached or can occur before the electrical conductors are inserted into their respective IDC elements 301, 300, which further minimizes the forces needed to close the cap 106 while making the proper connections.

Although the first IDC element 300 and the second IDC element 301 are shown staggered relative to the pivot axis 173, the first IDC element 300 and second IDC element 301 may be uniformly arranged within the housing 130. Further, the first IDC element 300 and the second IDC element 301 may have different heights relative to the base 134 of the housing 130 such that electrical conductors will first be inserted into the higher IDC element, and then into the lower IDC element. As mentioned above, the blades 162, 164 may also be staggered or have varying heights and the wire stuffers 180, 184 may also have different lengths. Sequencing the insertion of the electrical conductors into the IDC elements, along with sequencing the cutting of the electrical conductor, minimizes the forces needed to close the cap 106 while making the proper connections.

Although the housing 130 as shown and described has a first section 135 and a second section 137 with essentially similar components on each section, the housing 130 may include a single set of components like the wire groove, recess in the pivot portion, IDC element, blade, support, etc.

In use, an electrical conductor, which includes a conductive core surrounded by an insulation layer, is inserted into the first section 135 of the housing 130 and into the first recess 174. A similar electrical conductor can likewise be inserted into the second section 137 and into the second recess 176. Although it is preferable to insert the electrical conductor into each section of the housing one at a time, two electrical conductors may be inserted into each section of the housing 130. Once in place, the cap 106 is closed to insert the electrical conductors into the slots of the IDC element and the blade cuts the portion of the electrical conductor passing into the recesses.

Electrical conductors are typically electrically coupled (or "connected") to the connector assemblies 100 in the field. Accordingly, ease of use and achieving a high probability of effective electrical coupling of the components is important. The conditions of use and installation may be harsh, such as outdoors (i.e., unpredictable weather conditions), underground cabinets (i.e., tight working quarters), and non-highly skilled labor. Thus, the simpler the process of connecting an electrical conductor to the IDC element in the connector assembly, the better. The present invention achieves this end by providing an arrangement for aligning an electrical conductor for connection with an IDC element, and for providing an operator with affirmative feedback that the alignment was correct (and thus a proper electrical coupling has been made) even after the cap has been closed and the alignment of components is no longer visible. FIGS. 5, 6, and 7 illustrate the effective alignment and electrical coupling arrangement of the present invention.

As illustrated in FIGS. 5, 6, and 7, the first IDC element 300 has a first contact 302 and a second contact 303. The first contact 302 has a first insulation displacement slot 311 therein and the second contact 303 has a second insulation displacement slot 321 therein, with those insulation displacement slots configured to receive, in an electrically conductive manner, an electrical conductor (see FIGS. 8, 9, and 10 for further description of the first and second contacts 302, 303 of the first IDC element 300).

FIG. 5 is a schematic sectional view through the first section 135 of one of the housings 130, as taken along plane 136 (FIG. 4). The cap 106 is in an open position, and an electrical conductor 200 passes through the first recess 174 in the cap 106. A distal end 200*a* of the electrical conductor 200 is inserted into the first section 135 of the housing 130 and into the first recess 174. The electrical conductor 200 is aligned over the first IDC element 300 and first wire groove 140.

FIG. 6 is a schematic sectional view through the first section 135 of one of the housings 130, as taken along plane 136 (FIG. 4) with the electrical conductor 200 through the first recess 174 in the cap 106 and the cap 106 in the process of being closed, by application of force F on its upper surface. Proximally from the distal end 200*a*, the electrical conductor 200 passes through the first wire groove 140 (see FIGS. 4 and 6). To make the electrical connection between the electrical conductor 200 and first IDC element 300, a user begins to close the cap 106 by application of force F. As can be seen, the surface of the cap 106 is curved so as to allow a user's finger or thumb to easily engage and ergonomically close the cap 106.

The first wire stuffer 180 and first wire hugger 178 approach an upper exposed surface of the electrical conductor 200 and begin to make contact therewith. The electrical conductor 200 is thus urged into contact with first support 163, which is adjacent the first blade 162.

FIG. 7 is a schematic sectional view through the first section 135 of one of the housing 130, as taken along plane 136 (FIG. 4) with an electrical conductor cut and the cap 106 in a closed position. The electrical conductor 200 includes a conductive core 204 surrounded by an insulation sheath layer 202 (see FIGS. 9 and 10). When the electrical conductor 200 begins to make contact with the first IDC element 300, the electrical conductor 200 enters the second insulation displacement slot 321 and then enters the first insulation displacement slot 311 within the first IDC element 300. The insulation displacement slots 321, 311 have at least one part that is narrower than the overall electrical conductor 200 such that the insulation sheath layer 202 is displaced and the conductive core 204 makes electrical contact with the conductive IDC element.

When the cap 106 entirely closes, the resilient latch 188 flexes so that the latch projection 190 can engage with the latch opening 146 on the front wall 131 of the housing to lock the cap 106 in it closed position (see FIG. 4). The electrical conductor 200 extends proximally out of the housing 130 at the first wire groove 140 (see FIG. 4). When the cap is closed, the first wire stuffer 180 has entirely pressed and followed the electrical conductor 200 into the first insulation displacement slot 311 of the first contact 302 and the second insulation displacement slot 321 of the second contact 303 (see FIG. 8). The electrical conductor 200 has rested on the first support 163 and the pressure of the cap 106 on the electrical conductor 200 at the first blade 162 has severed the electrical conductor 200. The electrical conductor 200 remaining includes a proximal connected portion 201 electrically connected to the first IDC element 300 and a distal unconnected portion 203, which had extended through the first recess 174. Electrical conductor 200 has been severed adjacent the first recess 174, and the distal unconnected portion 203 is no longer electrically connected to the first IDC element 300. Thus, no portion of the electrical conductor 200, which extends through the cap 106 is in electrical contact with the first IDC element 300. In this embodiment, the first recess 174 passes entirely through the cap 106 and so the distal unconnected portion 203 of the electrical conductor 200 may be discarded.

The first and second recesses 174, 176 on the underside of the cap 106, may be generally circular (see FIG. 3). However, as can be seen in FIGS. 1, 2, 4, and 5-7, ends 174*a* and 176*a* of the first and second recesses 174, 176 visible on a top surface of the cap 106 have an oval shape. The oval shape allows a user better access to the distal unconnected portion 203 of electrical conductor 200 passing through the recesses 174, 176, and thus makes it easier to discard this waste. It is preferable that the recesses 174, 176 are through holes as shown in FIG. 7 so that the unconnected portion can be removed. However, the recesses 174, 176 may be openings in the pivot portion 166 of the cap 106 such that the cut portion of the electrical conductor remains in the recesses 174, 176 when the cap 106 is closed.

When the cap 106 is closed, the cap 106 may entirely seal the housing 130. Additionally, a gel or other sealant material may be added to the housing 130 prior to the closure of the cap 106 to create a moisture seal within the housing 130 when the cap 106 is closed. Sealant materials useful in this invention include greases and gels, such as, but not limited to RTV® 6186 mixed in an A to B ratio of 1.00 to 0.95, available from GE Silicones of Waterford, N.Y.

Gels, which can be described as sealing material containing a three-dimensional network, have finite elongation properties that allow them to maintain contact with the elements and volumes they are intended to protect. Gels, which are useful in this invention, may include formulations which contain one or more of the following: (1) plasticized thermoplastic elastomers such as oil-swollen Kraton triblock polymers; (2) crosslinked silicones including silicone oil-diluted polymers formed by crosslinking reactions such as vinyl silanes, and possibly other modified siloxane polymers such as silanes, or nitrogen, halogen, or sulfur derivatives; (3) oil-swollen crosslinked polyurethanes or ureas, typically made from isocyanates and alcohols or amines; (4) oil swollen polyesters, typically made from acid anhydrides and alcohols. Other gels are also possible. Other ingredients such as stabilizers, antioxidants, UV absorbers, colorants, etc. can be added to provide additional functionality if desired.

Useful gels will have ball penetrometer readings of between 15 g and 40 g when taken with a 0.25 inch diameter steel ball and a speed of 2 mm/sec to a depth of 4 mm in a sample contained in a cup such as described in ASTM D217 (3 in diameter and 2.5 in tall cylinder filled to top). Further, they will have an elongation as measured by ASTM D412 and D638 of at least 150%, and more preferred at least 350%. Also, these materials will have a cohesive strength, which exceeds the adhesive strength of an exposed surface of the gel to itself or a similar gel.

Representative formulations include gels made from 3-15 parts Kraton G1652 and 90 parts petroleum oil, optionally with antioxidants to slow decomposition during compounding and dispensing.

When the cap 106 is closed, the user cannot visually see if the electrical conductor 200 is properly in place within the first IDC element 300. However, the user is able to verify that the proximal portion of the electrical conductor 200 is properly extending through the first wire groove 140 and that the distal end 200*a* of the electrical conductor 200 has been cut by the blade 162. With the ability to verify that each end of the electrical conductor 200 has been properly placed, the user can interpolate that the middle of the electrical conductor 200 has been properly aligned and inserted into the IDC element.

The positioning and additionally the height from the base 134 of the housing 130 of the first IDC element 300, second IDC element 301, first blade 162, and second blade 164 all assist in reducing the forces necessary for making the electrical connection between the electrical conductors 200, 206 and the IDC elements 300, 301. The positioning and length of the first wire stuffer 180 and second wire stuffer 184 may also be manipulated to assist in reducing the forces necessary for closing the cap 106 and making the electrical connections. The present invention effectively allows for a distribution of the forces necessary for cutting the electrical conductor and electrically coupling the electrical conductor to the IDC element through the use of a pivoting cap, without the use of special closure tools by effectively sequencing the cutting of the electrical conductors and insertion of the electrical conductor into the contacts.

When an electrical conductor is positioned on both the first section 135 and the second section 137 of the housing 130, the electrical conductors are first cut at the blade either simultaneously or sequentially, depending on the arrangement of the blade. Then, as the cap continues to close, the wire stuffers sequentially stuff the electrical conductors into the first and second contacts of the second IDC element 301 and then into the first and second contacts of the first IDC element 300, when arranged as shown in FIG. 4. Because of the arced shape of the closing cap and the staggering of the IDC elements, the stuffing of the wires into the IDC elements does not occur all at once but sequentially, further reducing the closure force. After the electrical conductors are in place, the cap is snapped shut. Because the cutting, stuffing, and closing of the cap are all separated and do not occur at the same time, the force required by the user is reduced. Varying the height of the IDC elements with respect to one another or varying the lengths of the wire stuffers with respect to one another will also result in a sequential insertion of the electrical conductor in the contacts.

Although only a single electrical conductor 200 is described as entering the first section 135 of the housing 130, a second electrical conductor 206 (FIG. 4) may be inserted on top of the electrical conductor 200. It is preferable that the first electrical conductor 200 be entirely inserted first and then the cap 106 opened to receive the second electrical conductor 206. The second electrical conductor 206 would be inserted just as the first electrical conductor 200 was inserted as described above and shown in FIGS. 5-7. There may be instances where both electrical conductors may be inserted at once. The insertion of the electrical conductor 200 has been discussed with respect to only the first section 135 of the housing. However, it is understood that at the second section 137 of the housing 130 a single or even two electrical conductors may be inserted in a similar manner. Further description of the insertion of two electrical conductors is described in U.S. Pat. No. 7,101,216, the disclosure of which is hereby incorporated by reference.

Figure 8:
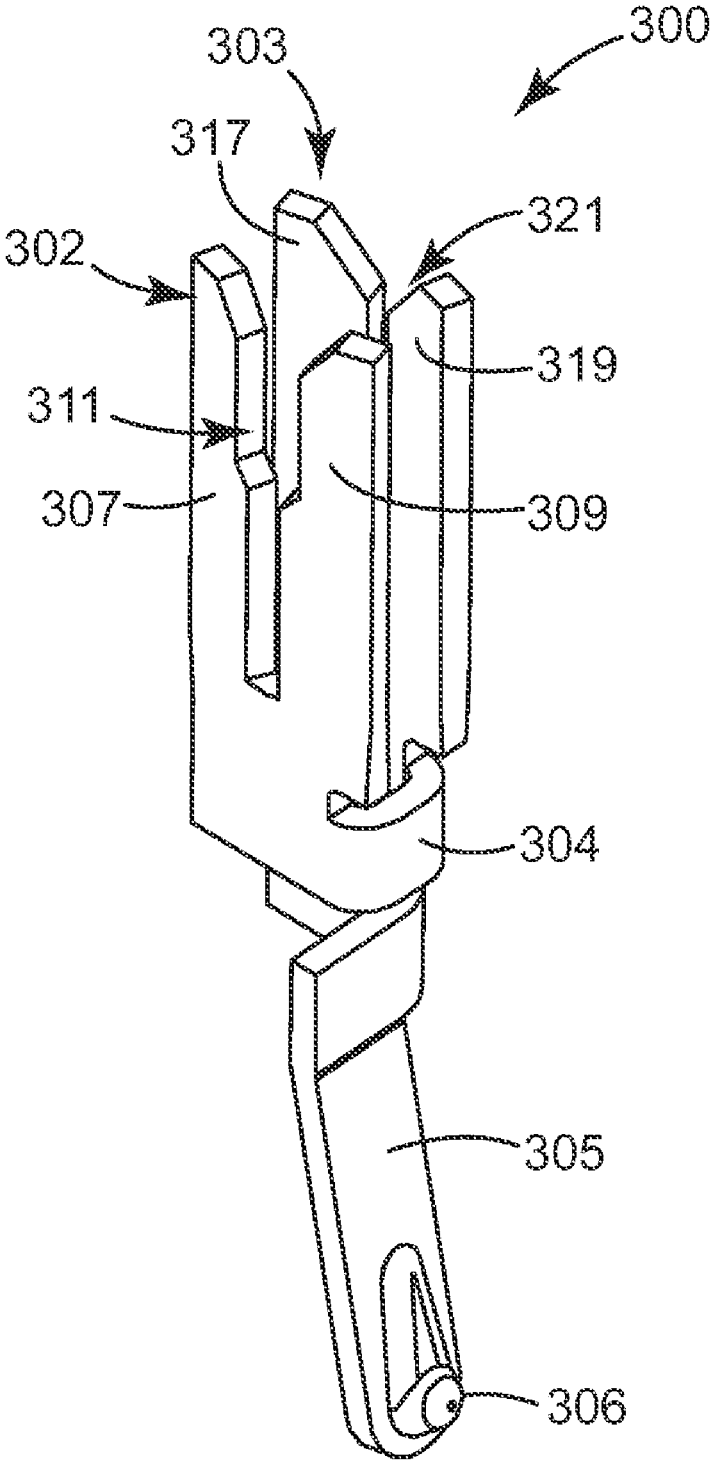
FIG. 8 is a perspective view of an insulation displacement element of the present invention.

FIG. 8 is a perspective view of the first IDC element 300. The first IDC element 300 includes the first contact 302 and the second contact 303, which are electrically connected to one another by a bridging section 304.

Extending below and biased from the bridging section 304 is a resilient tail 305. A raised tab 306 projecting from the tail 305 helps make an electrical connection to another element. When the first IDC element 300 is placed in the first section 135 of the housing 130, the tail 305 extends in a direction towards the test probe slot 152 (see FIGS. 11 and 12).

Figure 9:
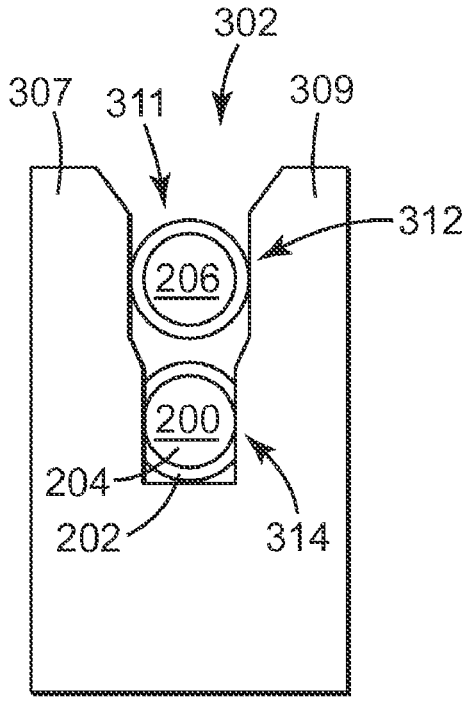
FIG. 9 is a front view of a U-shaped portion of a first contact of the insulation displacement element of the present invention.

As seen in FIG. 8 and FIG. 9, which is a front view of a portion of the first contact 302, the first contact 302 has a generally U-shape, including a first leg 307 and a second leg 309 spaced from one another to form a first insulation displacement slot 311. The first insulation displacement slot 311 has a wide portion 312 and a narrow portion 314. At the wide portion 312 the first leg 307 and the second leg 309 are spaced farther from one another than at the narrow portion 314. For the first contact 302, the wide portion 312 is located adjacent the open end of the first insulation displacement slot 311, while the narrow portion 314 is located intermediate the wide portion 312 and the closed end of the first insulation displacement slot 311.

Figure 10:
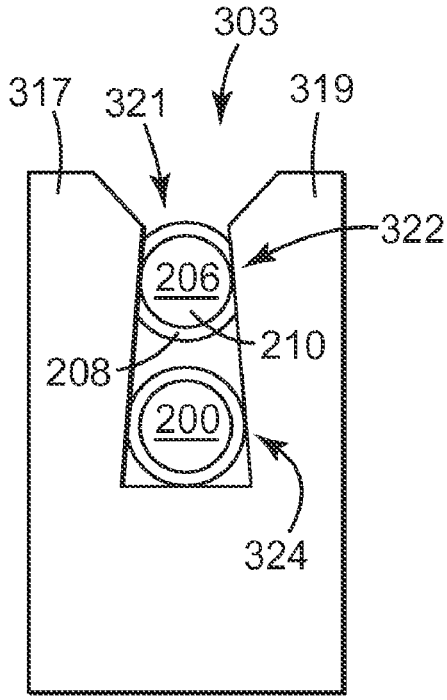
FIG. 10 is a front view of a U-shaped portion of a second contact of the insulation displacement element of the present invention.

As seen in FIGS. 8 and 10, which is a front view of a portion of the second contact 303, the second contact 303 also has a generally U-shape similar to the first contact 302, including a first leg 317 and a second leg 319 spaced from one another to form a second insulation displacement slot 321. The second insulation displacement slot 321 has a wide portion 324 and a narrow portion 322. However, the wide portion 324 of the second insulation displacement slot 321 is opposite to the wide portion 312 of the first insulation displacement slot 311. At the wide portion 324 the first leg 317 and the second leg 319 are spaced farther from one another than at the narrow portion 322. For the second contact 303, the narrow portion 322 is located adjacent the open end of the second insulation displacement slot 321, while the wide portion 324 is located intermediate the narrow portion 322 and the closed end of the second insulation displacement slot 321.

At the narrow portion 314 of the first contact 302, the first leg 307 and second leg 309 displace the insulation sheath 202 covering the first electrical conductor 200 so that the conductive core 204 makes electrical contact with the legs 307, 309. At the narrow portion 322 of the second contact 303, the first leg 317 and second leg 319 displace the insulation sheath 208 covering the second electrical conductor 206 so that the conductive core 210 makes electrical contact with the legs 317, 319. Therefore, the first and second electrical conductors 200, 206 are electrically connected to the first IDC element 300, and are electrically connected to one another.

Although not shown independently as in FIG. 8, the second IDC element 301 is similar to the first IDC element 300. However, its tail extends in the opposite direction. The tail of the second IDC element 301 extends towards the center to the test probe slot 152. The second IDC element 301 may also be configured with first and second contacts having wide portions and narrow portions. The wide portion and narrow portions may be configured in reverse order, relative to the first IDC element 300 (as considered from a radial perspective relative to the pivot axis 173).

Although the IDC element is shown having a first contact 302 and a second contact 303, it is understood that the IDC element may be an IDC element with just one contact. Also, the IDC element of the present invention may or may not have the wide portion and narrow portion described with respect to the IDC element shown in the FIGS. and in particular in FIG. 8. Further description of various insulation displacement connector elements and combinations thereof for use with the housing of the present invention is described in U.S. Pat. No. 7,101,216, the disclosure of which is hereby incorporated by reference.

Any standard telephone jumper wire with PCV insulation may be used as the electrical conductor. The wires may be, but are not limited to: 22 AWG (round tinned copper wire nominal diameter 0.025 inches (0.65 mm) with nominal PVC insulation thickness of 0.0093 inches (0.023 mm)); 24 AWG (rounded tinned copper wire nominal diameter 0.020 inches (0.5 mm) with nominal PVC insulation thickness of 0.010 inches (0.025 mm); 26 AWG (rounded tinned copper wire nominal diameter 0.016 inches (0.4 mm) with nominal PVC insulation thickness of 0.010 inches (0.025 mm).

FIG. 11 is a perspective view through the connector unit 104 (shown in phantom) showing the connection between the first IDC element 300 and an electrical element 114. The first IDC element 300 is positioned in the connector unit 104 with the tail 305 extending into the base unit 102 (not shown). The electrical element 114 is an IDC element, which makes electrical connection with cables that may be connected to the office or the subscriber. The electrical element 114 has a tail 114*a* that resiliently and electrically contacts the tail 305 of the first IDC element 300.

FIG. 12 is a perspective view through the connector unit 104 (shown in phantom) showing a test probe 350 inserted between the connection of the first IDC element 300 and the electrical element 114. The test probe 350 is first inserted through the test probe slot 152 (see FIG. 2 and FIG. 4). The test probe 350 is capable of breaking the contact between the first IDC element 300 tail 305 and the tail 114*a* of the electrical element 114. Breaking this connection and using a test probe, as is known in the art, allows the tester to electrically isolate a circuit on both sides of the test probe 350 at the IDC tail connection and thus to test both ways for problems.

Although FIGS. 11 and 12 show the electrical connection between the first IDC element 300 and electrical element 114, it is understood that the second IDC element 301 would also make a connection to another electrical element (similar to the element 114 shown and described). However, the second IDC element 301 is positioned on the second section 137 of the housing and therefore on the opposite side of the test probe slot 152. The test probe 350 is capable of entering the test probe slot 152 and breaking the resilient connection between the tail of the second IDC element 301 and the tail of the other electrical element (the tail orientations would be similar to that described above, but in reverse).

Figure 13:
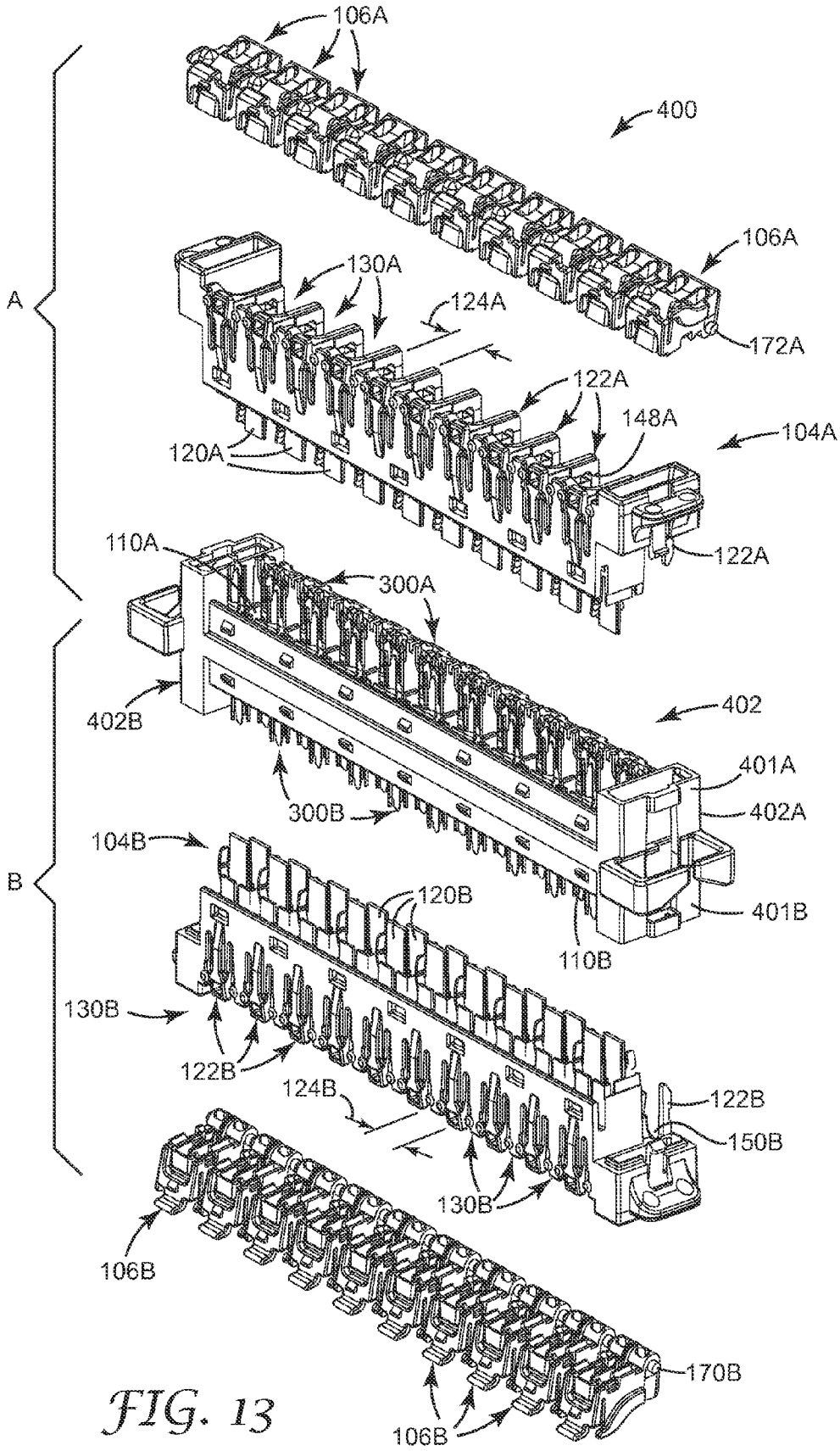
FIG. 13 is an exploded perspective view of a second exemplary embodiment of a connector assembly of the present invention.

In a second exemplary embodiment of a connector assembly, the connector assembly 100 shown in FIG. 1 is modified to include a connector unit 104 and a plurality of caps 106 on two opposing sides of a base unit. FIG. 13 is an exploded perspective view of the second exemplary embodiment. FIG. 13 illustrates an insulation displacement connector assembly 400 that includes a first side A and second side B, where the second side B is positioned on an opposite side of the base unit 402 from the first side A. For those components that are particular to either side A or side B, each reference number in FIG. 13 includes an "A" designation indicating that the XXXA element is positioned on the first side A or a "B" designation indicating that the XXXB element is positioned on the second side B.

The first side A includes a connector unit 104A and a plurality of caps 106A, while the second side B includes a connector unit 104B and a plurality of caps 106B. Caps 106A each include pivot projections 170A (not shown in FIG. 13) and 172A, which are configured to engage with hinge slots 148A and 150A (not shown in FIG. 13). Specifically, caps 106A each fit within a gap 124A between adjacent lock projections 122A of the connector unit 104A. Similarly caps 106B each include pivot projections 170B and 172B (not shown in FIG. 13), which are configured to engage with hinge slots 148B (not shown in FIG. 13) and 150B. Caps 106B each fit within a gap 124B between adjacent lock projections 122B of the connector unit 104B.

With the exception of the base unit 402 and each of the IDC elements 300B within the second side 402B of the base unit 402 (discussed in reference to FIG. 14), each component of the connector assembly 400 is similar in structure to the corresponding components of the connector assembly 100 shown in FIG. 1, and the similar components are like-numbered for clarity of illustration and description. For example, the connector units 104A and 104B are identical in structure to the connector unit 104 shown in FIG. 1, while each one of the caps 106A and 106B is identical in structure to each one of the caps 106 shown in FIG. 1. Therefore, the description of the connector unit 104 in reference to FIGS. 1-12 above applies equally to the description of the connector units 104A and 104B, and likewise for the description of the caps 106 with respect to the caps 106A and 106B.

The base unit 402 comprises a first side 402A that corresponds with the first side A of the connector assembly 400 and a second side 402B that corresponds with the second side B of the connector assembly 400. The first side 402A of the base unit 402 includes an insulated housing 401A with a series of receiving slots 110A for connection with the connector unit 104A. The connector unit 104A comprises an insulated housing with a series of alignment projections 120A for connection into the receiving slots 110A of the base unit 102A. Lock slots (not shown) on a rear side of the first side 402A of the base unit 402 receive lock projections 122A of the connector unit 104A to lock the connector unit 104A to the base unit 402A.

Similarly, the second side 402B of the base unit 402 includes an insulated housing 401B with a series of receiving slots 110B for connection with the connector unit 104B. The connector unit 104B comprises an insulated housing with a series of alignment projections 120B for connection into the receiving slots 110B of the base unit 102B. Lock slots (not shown) on a rear side of the second side 402B of the base unit 402 receive lock projections 122B of the connector unit 104B to lock the connector unit 104B to the base unit 402B. In the embodiment shown, the insulated housings 401A and 401B are an integral unit. However, in alternate embodiments, the insulated housings 401A and 401B may be separate units that are adhered together using a suitable means.

Within the first side 402A of the base unit 402 is a first set of electrical elements (e.g., IDC elements) 300A and within the second side 402B of the base unit 402 is a second set of electrical elements 300B. Each one of the electrical elements in the first set of electrical elements 300A is electrically connected to an electrical element in the second set of electrical elements 300B. The electrical connection between two corresponding IDC elements 300A and 300B will be described in further detail below. Just as with the first exemplary embodiment of the connector assembly 100 shown in FIG. 1, one or more of the IDC elements 300A may be disposed within each of the housings 130A of the connector unit 104A and one or more of the IDC elements 300B may be disposed within each of the housings 130B of the connector unit 104B when the connector assembly 400 is assembled.

While the IDC elements 300A and 300B are connected to the base 402, the IDC elements 300A and 300B are aligned to be received in the housings 130A and 130B, respectively, when the connector assembly 400 is assembled. In this way, at least one IDC element 300A is "disposed" within each of the housings 130A and at least one IDC element 300B is "disposed" within each of the housings 130B of the connector unit 104B. In an alternate embodiment, the IDC elements 300A are connected to the connector unit 104A and at least one of the IDC elements 300A is predisposed in each of the housings 130A, while the IDC elements 300B are connected to the connector unit 104B and at least one of the IDC elements 300B is predisposed in each of the housings 130B.

The connector assembly 400 is used to form an electrical connection between two cables. For example, an IDC element 300A positioned on the first side 402A of the base unit 402 may be used to form an electrical connection with a jumper wire that is electrically connected to another connector block, while a corresponding IDC element 300B on the second side 402B of the base unit 402 may be used to form an electrical connection with a cable that is connected to an office or a subscriber. If the IDC element 300A is electrically connected to the IDC element 300B, the jumper wire is electrically connected to the cable connected to the office or the subscriber.

Figure 14:
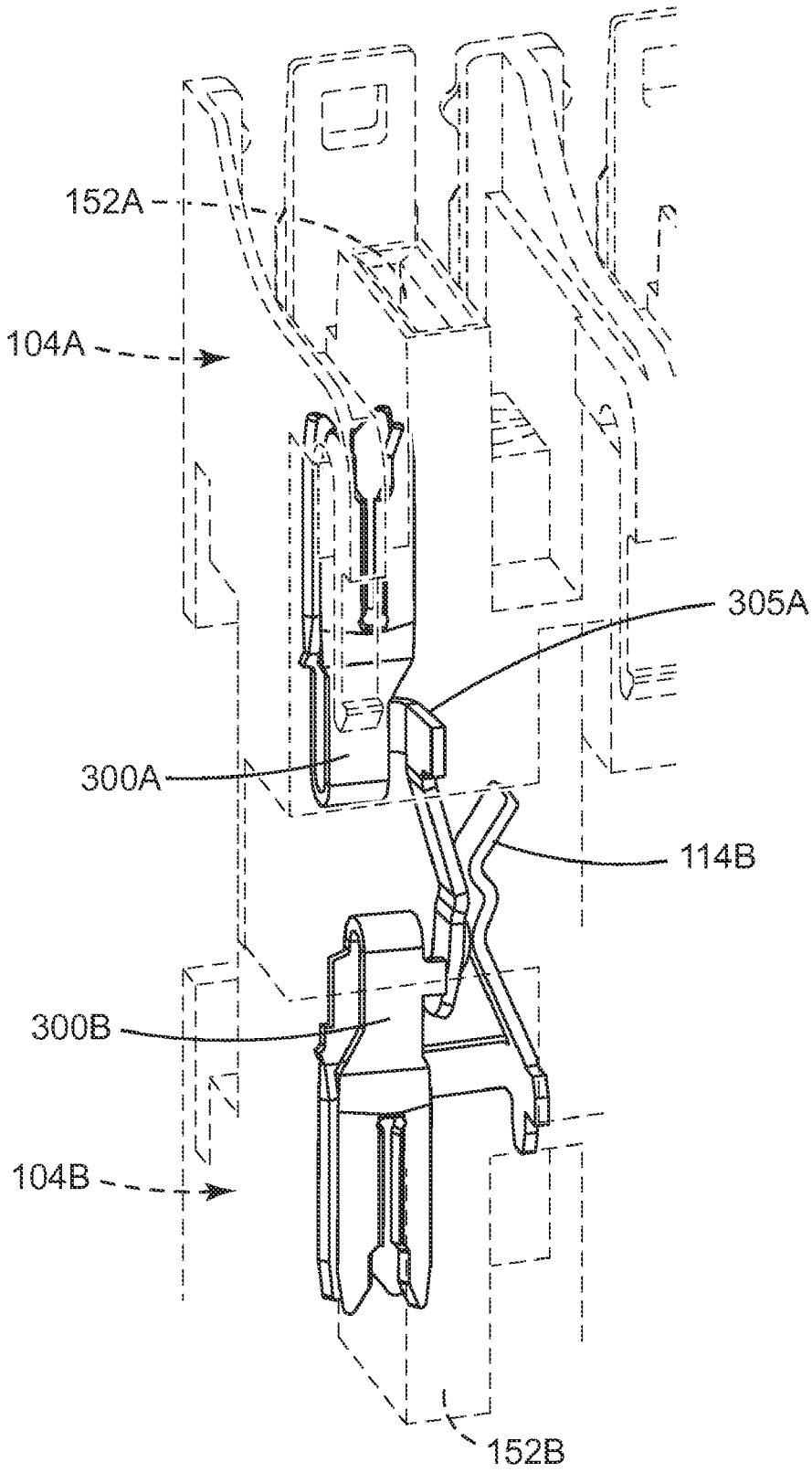
FIG. 14 is a perspective view through a connector block (shown in phantom) in accordance with the second exemplary embodiment, illustrating the connection between an insulation displacement element on a first side of the connector block and an insulation displacement element on a second side of the connector block.

FIG. 14 is a perspective view through the connector units 104A and 104B (shown in phantom) after the connector assembly 400 is assembled. Portions of the connector unit 104B have been removed for clarity of illustration. FIG. 14 illustrates the connection between an IDC element 300A positioned on the first side 402A of the base unit 402 and an IDC element 300B positioned on the second side 402B of the base unit 402. The IDC element 300A is similar in structure to the IDC element 300 (shown and described in reference to FIG. 8). The description of the IDC element 300 is incorporated herein as the description of the structure of the IDC element 300A. The IDC element 300A is positioned within the connector unit 104A with a tail 305A extending into the first side 402A (not shown) of the base unit 402 (not shown). The tail 305A is similar in structure to the tail 305 of IDC element 300 (shown in FIG. 8), and the description of the tail 305 is incorporated herein as the description of the structure of the tail 305A. As described in reference to FIG. 13, a jumper cable may be introduced into the IDC element 300A, which makes an electrical connection therewith.

The IDC element 300B is positioned within the connector unit 104B. IDC element 300B shares structural features with both the IDC element 300 and the electrical element 114 (shown in FIG. 11). Specifically, the IDC element 300B is identical in structure to the IDC element 300, except that rather than including a tail similar to the tail 305 of the IDC element 300, the IDC element 300B includes a tail 114B that is similar in structure to the tail 114*a* of electrical element 114 (FIG. 11). The relevant descriptions of the IDC element 300 and the tail 114*a* are incorporated herein as the description of the structure of the IDC element 300B. As described in reference to FIG. 13, the IDC element 300B may make an electrical connection with a cable that is to the office or the subscriber. The tail 114B resiliently and electrically contacts the tail 305A of the IDC element 300A. In this way, a cable that electrically contacts the IDC element 300A is electrically connected to a cable that electrically contacts the IDC element 300B.

As with the first exemplary embodiment, a test probe (e.g., test probe 350 shown in FIG. 12) may be inserted into the testing device slot 152A or 152B and between the tail 305A and the tail 114B in order for a tester to electrically isolate a circuit and test the circuit.

Figure 15:
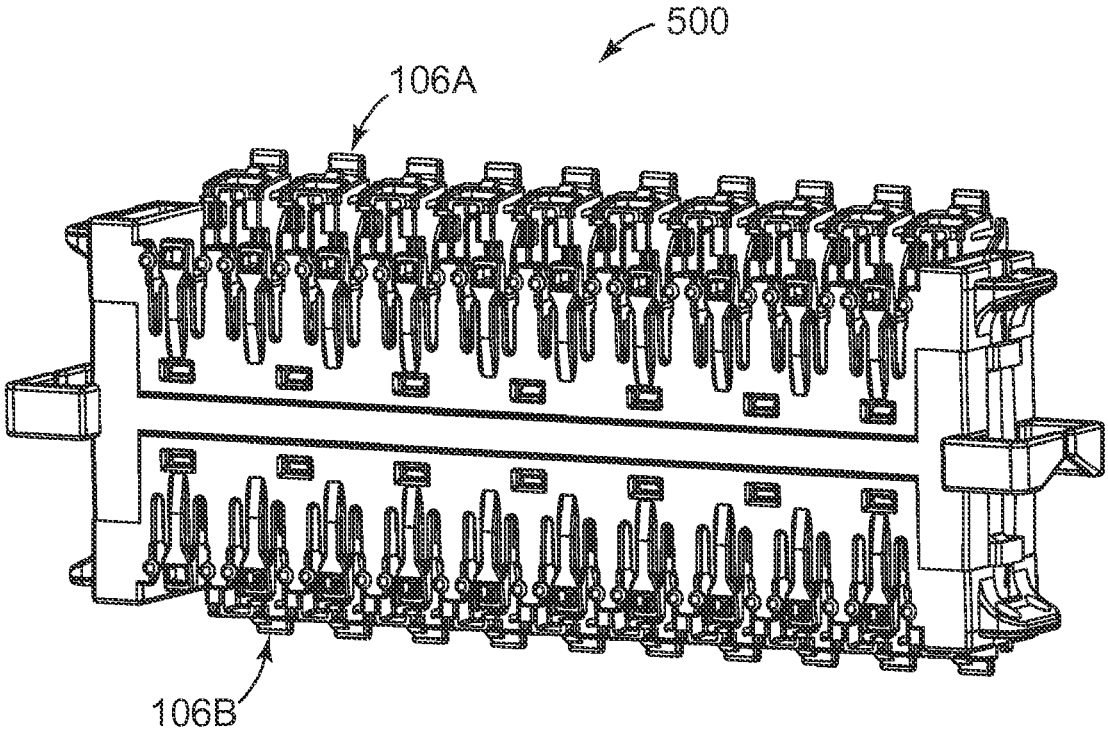
FIG. 15 is a perspective view of an assembled connector block in accordance with the second exemplary embodiment.

FIG. 15 is a perspective view of an assembled connector block 500 in accordance with the second exemplary embodiment. The connector block assembly 400 shown in FIG. 13 has been assembled to form the connector block 500. A telecommunications worker or other user may use the connector block 500 to complete a circuit that electrically connects a subscriber cable (connected to the connector block 500) with a service provider cable (connected to a second connector block, which may be similar to the connector block 500). The connector block 500 allows the user to make an electrical connection between the first connector block 500 and the second connector block 500 without the use of a tool.

In many existing connector blocks, at least one tool is needed to introduce an electrical conductor into a slot in an IDC element and/or sever any unnecessary portions of the cable. In contrast, each of one of the caps 106A and 106B include wire stuffers (e.g., wire stuffers 180 and 184 shown in FIG. 3), which are configured to urge an electrical conductor into a slot in an IDC element (e.g., IDC elements 300A and 300B of FIGS. 13 and 14). The wire stuffers eliminate the need for a tool for introducing an electrical conductor into a slot in the IDC element. The connector block 500 also includes a cutting edge (e.g., blades 162 and 164 shown in FIGS. 4-7) that severs unnecessary portions of the electrical conductor. This eliminates the need for a cutting tool. The elimination of these tools helps to improve the efficiencies of the electrical connection process.

Although the present invention has been described with reference to preferred embodiments, workers skilled in the art will recognize that changes may be made in form and detail without departing from the spirit and scope of the invention.

What is claimed is:

1. An electrical connector comprising:

a first housing, a second housing, and a base unit interposed between and coupling the first housing and the second housing, wherein the first and second housings each comprise:

a cavity for receiving an IDC element;

a cap pivotable between an open position and a closed position and including a pivot portion and a cover portion, wherein the pivot portion is pivotally mounted to the housing;

a recess in the pivot portion of the cap; and a cutting edge within the cavity of the housing and adjacent to the recess in the pivot portion of the cap to sever a portion of an electrical conductor.

2. The electrical connector of claim 1 wherein the recess comprises a through hole passing through the pivot portion of the cap.

3. The electrical connector of claim 1 wherein the cap further comprises:

at least one guide on the cover portion of the cap aligned to engage the electrical conductor, the guide aligning the electrical conductor with the IDC element when the cap is moved toward the closed position.

4. The electrical connector of claim 3 wherein the cap further comprises:

a projection on the cover portion of the cap adjacent to the guide and aligned with an insulation displacement slot within the IDC element, the projection urging the electrical conductor into the insulation displacement slot within the IDC element when the cap is moved toward the closed position.

5. The electrical connector of claim 1 wherein the cap further comprises:

a locking latch on the cover portion of the cap that engages with a front wall of one of the first housing or the second housing to releasably fix the cap in the closed position.

6. The electrical connector of claim 1 wherein the cavity comprises:

a first cavity for receiving a first IDC element; and a second cavity for receiving a second IDC element.

7. The electrical connector of claim 6 in combination with a first electrical conductor and a second electrical conductor connected thereto, wherein:

the first electrical conductor is disposed in the first cavity and is engaged with the first IDC element; and the second electrical conductor is disposed in the second cavity and is engaged with the second IDC element.

8. The electrical connector of claim 7 further comprising:

a first wire hugger on the cover portion of the cap aligned with the first cavity and configured to engage the first electrical conductor; and a second wire hugger on the cover portion of the cap aligned with the second cavity and configured to engage the second electrical conductor, wherein the first wire hugger aligns the first electrical conductor with the first IDC element and the second wire hugger aligns the second electrical conductor with the second IDC element when the cap is moved toward the closed position.

9. The electrical connector of claim 7 further comprising:

a first wire stuffer on the cover portion of the cap and aligned with the first cavity adjacent to the first wire hugger and with a first insulation displacement slot within the first IDC element; and a second wire stuffer on the cover portion of the cap and aligned with the second cavity adjacent to the second wire hugger and with a second insulation displacement slot within the second IDC element, wherein the first wire stuffer urges the first electrical conductor into the first insulation displacement slot within the first IDC element and the second wire stuffer urges the second electrical conductor into the second insulation displacement slot within the second IDC element when the cap is moved toward the closed position.

10. The electrical connector of claim 6 wherein the recess in the pivot portion of the cap comprises:

a first recess in the pivot portion of the cap aligned with the first cavity; and a second recess in the pivot portion of the cap aligned with the second cavity.

11. The electrical connector of claim 10 wherein the first and second recess each comprise a through hole passing through the pivot portion of the cap.

12. The electrical connector of claim 10 wherein the cutting edge comprises:

a first cutting edge adjacent to the first recess; and a second cutting edge adjacent to the second recess.

13. The electrical connector of claim 10 wherein the first recess and a first insulation displacement slot of the first IDC element within the first cavity are linearly aligned.

14. The electrical connector of claim 10, wherein the second recess and a second insulation displacement slot of the second IDC element within the second section of the cavity are substantially linearly aligned.

15. The electrical connector of claim 6 wherein the first IDC element is closer to the pivot portion of the cap than the second IDC element.

16. The electrical connector of claim 1 wherein the IDC element comprises:

a first contact; and a second contact electrically connected to the first contact, wherein the first contact and second contact are configured to receive the electrical conductor.

17. The electrical connector of claim 16 wherein the IDC element further comprises a first conductive tail extending below the first contact to make contact with a second conductive tail of the second contact.

18. The electrical connector of claim 17 wherein a test probe may be inserted between the first and second conductive tails.

19. The electrical connector of claim 1 wherein the cap is removably connected to one of the first housing and the second housing, the cap further comprising a pin attached to the pivot portion of the cap and configured to engage with a socket in one of the first housing and the second housing.

20. An electrical connector assembly comprising: a first connector unit, a second connector unit, and a base unit having a first side and a second side opposite side the first side, the base unit interposed between and coupling the first and the second connector units wherein the base unit comprises:

a first set of insulation displacement connector (IDC) elements on the first side of the base; and a second set of IDC elements on the second side of the base;

wherein the first connector unit is attached to the first side of the base unit and includes a first set of housings;

a first set of caps pivotally mounted to the first connector unit;

wherein the second connector unit is attached to the second side of the base unit and includes a second set of housings; and a second set of caps pivotally mounted to the second connector unit, wherein each cap of the first and second sets of caps includes a recess in a pivot portion of the cap and configured to receive an electrical conductor, and wherein each housing of the first and second sets of housings includes a cutting edge adjacent to the recess to sever a portion of an electrical conductor.

* * * * *